US005980108A

United States Patent [19]

Pasbrig

[11] Patent Number: 5,980,108

[45] Date of Patent: Nov. 9, 1999

[54] MULTIPART AIR-CONDITION PACKAGING CONTAINER

[75] Inventor: Max Herbert Pasbrig, Orselina, Switzerland

[73] Assignee: LaCrex SA, Orselina, Switzerland

[21] Appl. No.: 09/038,099

[22] Filed: Mar. 11, 1998

[51] Int. Cl.[6] ..... B65D 33/01

[52] U.S. Cl. ..... 383/75; 383/101; 383/117

[58] Field of Search ..... 383/75, 100, 101, 383/102, 117

[56] References Cited

U.S. PATENT DOCUMENTS

| | | | |
|---|---|---|---|
| 264,526 | 9/1882 | Grauwiler | 383/75 X |
| 2,502,586 | 4/1950 | Ottinger | 383/102 X |
| 3,674,188 | 7/1972 | Anderson | 383/102 X |
| 4,395,254 | 7/1983 | Schuster | 383/102 X |
| 4,550,546 | 11/1985 | Raley et al. | 383/101 X |

FOREIGN PATENT DOCUMENTS

| | | | |
|---|---|---|---|
| 1809578 | 7/1970 | Germany | 383/101 |

*Primary Examiner*—Jes F. Pascua

[57] ABSTRACT

A multi-part, air-conditioned packaging container provides ventilated storage of foods. The container has an outer covering having openings, a breathing plastic-film inner covering provided with openings, and a closure device for the openings, which can be used as a carrying or hanging device. The outer covering is made of air-permeable breathing material and the inner covering in made of a perforated plastic film. Between these coverings an air-conditioning zone is formed. The openings can be closed by double-pull closure system.

9 Claims, 2 Drawing Sheets

MULTIPART AIR-CONDITION PACKAGING CONTAINER

FIELD OF THE INVENTION

The invention relates to a multipart, air-conditioned packaging container, in particular for the ventilated storage of foods.

BACKGROUND OF THE INVENTION

From DE-GM 19 58 775, a two-part packaging container for gâteaux and similar baked goods is known, which consists of an upper part made of transparent plastic film and a plane lower part, which are to be interconnected after the introduction of the baked goods. This known two-part packaging container is not, however, suitable as packaging for different foods, but intended and suitable exclusively for certain baked goods.

In another known packaging container of this type, the ventilation of the contents takes place by means of holes made in a plastic film, the plastic film being sewn firmly into a cotton covering and having an opening for the insertion and removal of the filling product. This type of packaging container is intended as a keep-fresh bag for baked goods, but has certain shortcomings, as practice has shown. Thus the ventilation of the baked goods also suffers as a result of air-holes which are made in insufficient number and only on part of the surface, so that only partially is an air-conditioned ventilation of the inner space and of the contents guaranteed. Moreover, the crumbs, which become detached from the baked goods, fall through these holes in the film and are deposited between the plastic film and the cotton covering and, in the event of lengthy storage, cause unhygienic attack of the same and of the baked goods located therein. By means of sewing in the plastic film at all seam points of the cotton covering, a removal of the crumbs or the like, which have collected in between, and hygienic cleaning of the keep-fresh bag is only partially, if at all, possible. By means of sewing in of the film, the latter is damaged, so that, upon insertion or removal of the baked goods, tearing of the film along the seam points is caused and the functioning of the keep-fresh bag is no longer guaranteed.

SUMMARY OF THE INVENTION

It is, therefore, the aim of the invention to produce a packaging container which renders possible a particular ventilation of the contents, its hygienic storage and hygienic cleaning of the container, and limits damage of the inner covering and, additionally, can be manufactured simply and economically.

Advantageous developments of the invention are claimed in the subclaims.

The solution according to the invention makes possible ventilated air-conditioned packaging and storage as well as keeping fresh of different baked goods. By means of the air-conditioned zone between the outer covering made of natural cotton or similar material and the breathing, perforated polyethylene-film inner covering, baked goods remain fresh in the fullness of flavour for days. Different types of vegetable, such as onions, potatoes or the like, which require airy and dark storage, can advantageously be stored therein in the packaging container. The air-conditioned zone acts like a freshness safe and the loss of moisture is prevented as only air which keeps fresh has access.

A further advantageous development is the hot-needle perforation of the polyethylene film of the inner covering.

By these means, the crumbs or the like, which become detached from the baked goods etc., are prevented from being deposited in the air-conditioned zone and, in the event of lengthy storage, being unhygienically attacked there. In this connection, it is essential that the inner covering is arranged with the side which has the lips towards the inner side of the outer covering.

According to a preferred embodiment, two double cords, which, connected by means of loops and knots at their ends and mutually staggered, are arranged movably in a free space, serve as closure device. These also serve as carrying and/or hanging device. A particular air-conditioning effect is achieved if the packaging container is hung up by the cords and the opening is only partially closed, which is possible by means of the two cords.

According to an embodiment, the connection and fastening of the inner covering to the outer covering is provided only in the region of the insertion opening, in order to make possible hygienic cleaning of the inner parts of the packaging container and to prevent tearing of the inner covering upon the insertion or removal of baked goods which do not have a smooth surface. The free space for the cords in the region of the insertion opening is produced by means of bending over and welding of the inner covering. The side surfaces of the inner covering can also be interconnected by means of welding. In the case of the outer covering, a seam connection is provided instead of welding.

According to a preferred embodiment, a recess is provided for hygienic cleaning of the climatic zone in the inside shell in the area of the insert opening.

BRIEF DESCRIPTION OF THE DRAWINGS

The invention is described in greater detail below with reference to an exemplary embodiment which is also schematically illustratet in the drawing, in which.

DETAILED DESCRIPTION

Figure 1:
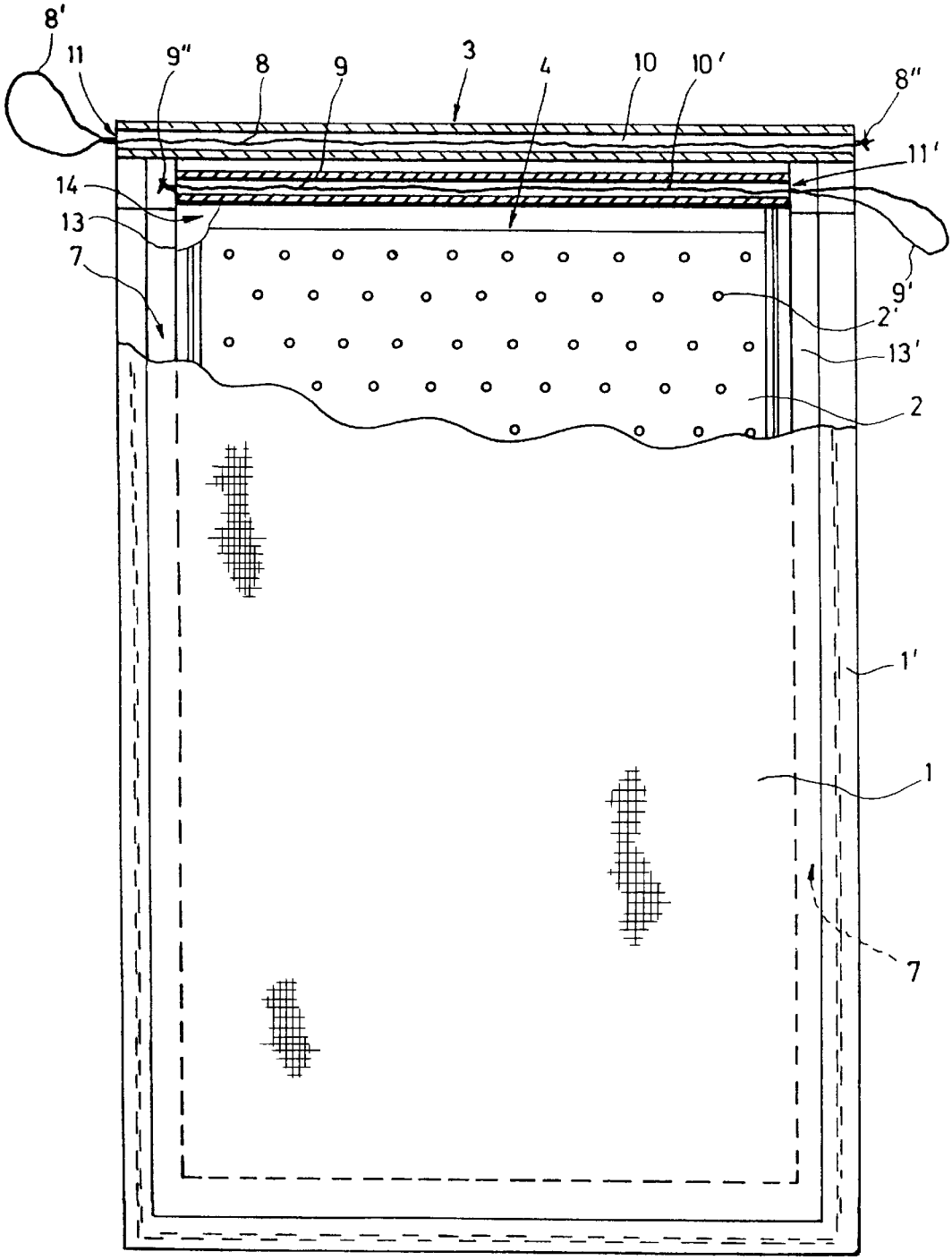
FIG. 1 shows a partial lonngitudinal cross-section through an embodiment of a packing container FIG. 2 Shows a transverse cross-section through an embodiment of a packaging container.

The packaging container illustrated in FIG. 1 consists of an outer covering 1 made of natural cotton fabric and an inner covering 2 made of a polyethylene film which has been perforated using hot needles. The outer covering, which is made by means of seams 1' from a cotton material strip or the like, has an opening mouth 3 with a tubular free space 10 at the periphery of the mouth 3 which is produced by means of bending over and sewing of the ends of the strip and in which the inner covering 2 is fastened and a double cord 8 movably arranged. The inner covering 2, which consists of a film strip, is welded together at its sides 13 and 13' and has an opening or mouth 4 with a tubular free space 10' at the periphery of the mouth 4 which is made by means of bending over and welding of the ends of the film and in which a double cord 9 is movably arranged. The double cords 8 and 9, which form a closure device, are interconnected by means of loops 8' and 9' as well as knots 8" and 9" and guided out of the free spaces 10 and 10' to the outside through cutouts 11 of the inner covering and 11' of the outer covering 1, so that they form a double-pull closure system, by means of which the openings 3 and 4 can be closed. Between the outer covering 1 and the inner covering 2, an air-conditioned zone 7 is provided, which is closed in the region of the opening 3.

Figure 2:
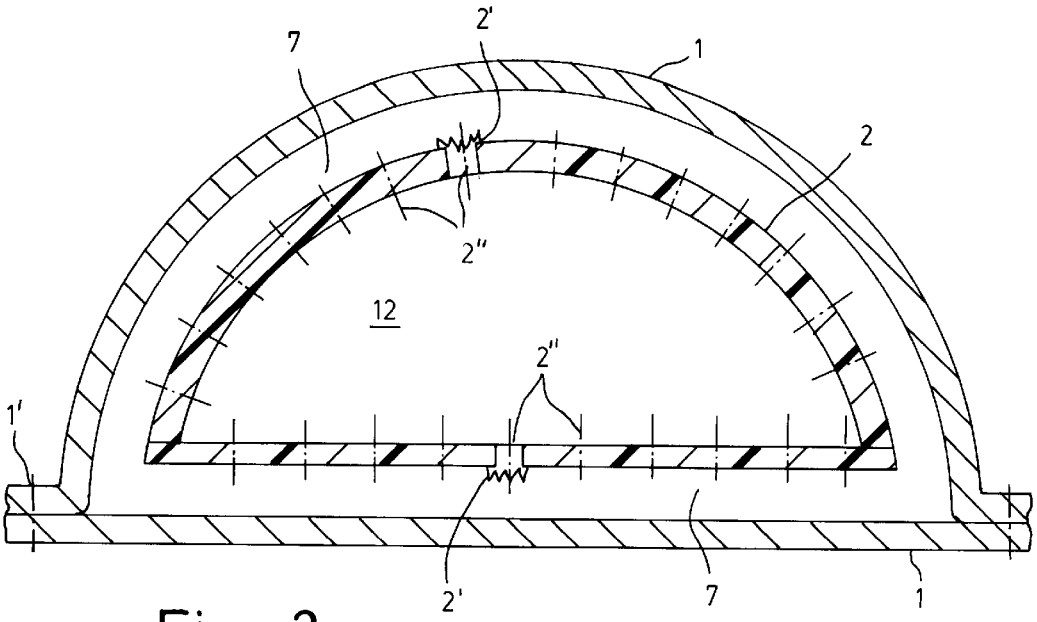

As illustrated in FIG. 2, the lips 2', which arise as a result of the hot-needle perforation of the polyethylene film, are arranged on the outer side of the inner covering 2 and directed towards the inner side 1' of the outer covering 1, whereas the smooth periphery lip-free side 2" is arranged towards the inner space 12.

Figure 3:
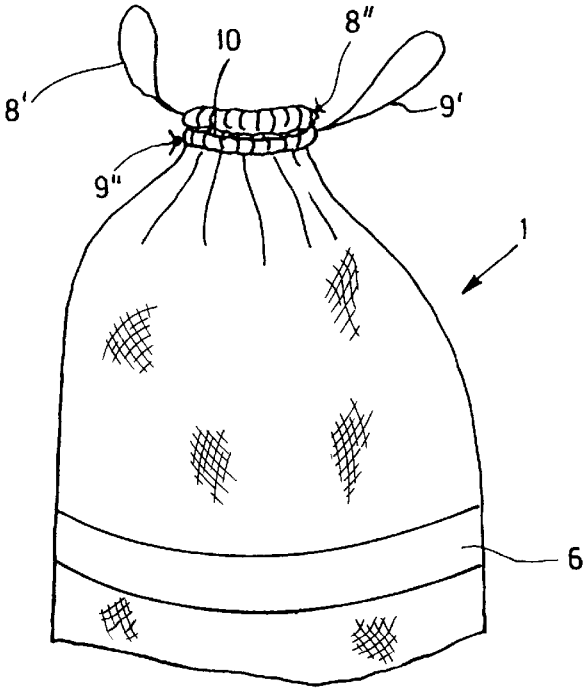
FIG. 3 shows a view from above of an embodiment of a packaging container.

In the bag shape of the packaging container illustrated in FIG. 3, the openings 3 and 4 are partially closed by means of the double cords 8 and 9 which have been pulled outwards by their loops 8' and 9'. The loops can in this connection serve as a carrying or hanging-up device (not illustrated).

The invention is not restricted to the exemplary embodiments illustrated, as other shapes and dimensions are envisaged according to the filling product to be looked after. The packaging container can thus be designed and used as a shopping bag, a bread and/or roll bag in order to keep the baked goods oven-fresh. A number of polyethylene films can also be used as inner covering and the closure device can consist of only one cord.

We claim:

1. A packaging container providing a sack for storing baked goods and vegetables, the container comprising:

an outer covering (1) made of an air-permeable breathable fabric material and defining a first space (10) of a defined volume;

an inner covering (2) of a perforated plastic film, which plastic film has projecting lips (2') and lipless peripheries (2") on opposite sides of each perforation, the plastic film defining a second space (12) of a defined volume adapted to contain baked goods and vegetables; the inner covering (2) being enclosed by the outer covering (1) with the projecting lips (2') extending outwardly from the second covering and the smooth peripheries (2") facing into the space (12) enclosure;

a space defining a zone (7) between the inner and outer coverings allowing the food within the inner covering (2) to be conditioned with air in the zone (7), and both the outer and inner coverings (1 and 2) having closed bottom ends and having mouths at ends opposite the bottom ends, the mouths being defined by openings (3 and 4), the mouths having draw strings (8 and 9) disposed at the peripheries thereof for closing the mouths (3 and 4), and the outer and inner coverings (1 and 2) being fixed to one another only at the mouths and not at the permanently closed ends thereof.

2. Packaging container according to claim 1 wherein the outer covering (1) is comprised of natural cotton.

3. Packaging container according to claim 1 wherein the inner covering (2) is polyethylene film with the lips (2') being formed thereon by perforation using hot needles.

4. Packaging container according to claim 1, wherein the outer covering (1) and the inner covering (2) are interconnected at the openings (3 and 4).

5. Packaging container according to claim 1, wherein the double-pull closure system of the mouths (3) and (4) consists of double cords (8 and 9) which are connected by means of loops (8') and (9') and knots (8") and (9") and are arranged to move freely in a tubular space at the mouths.

6. Packaging container according to claim 1, wherein the inner covering (2) has an aperture adjacent the opening (4) formed by the mouth.

7. Packaging container according to claim 1, wherein the outer covering (1) and the inner covering (2) have shapes defining a bag or a carrier bag.

8. Packaging container according to claim 1, wherein an inscription surface (6) is provided on the outer covering (1).

9. Packaging container according to claim 1, wherein the cords (8, 9) have loops which are used as carrying or handing device.

* * * * *